US011209150B1

(12) United States Patent
Lu et al.

(10) Patent No.: US 11,209,150 B1
(45) Date of Patent: Dec. 28, 2021

(54) COLOR TEMPERATURE ADJUSTABLE LAMP SOCKET AND COLOR TEMPERATURE ADJUSTABLE LAMP TUBE

(71) Applicant: Xiamen PVTECH Co., Ltd., Fujian (CN)

(72) Inventors: Fuxing Lu, Fujian (CN); Rongtu Liu, Fujian (CN); Honggang Sun, Fujian (CN)

(73) Assignee: Xiamen PVTECH Co., Ltd., Fujian (CN)

( * ) Notice: Subject to any disclaimer, the term of this patent is extended or adjusted under 35 U.S.C. 154(b) by 0 days.

(21) Appl. No.: 17/195,552

(22) Filed: Mar. 8, 2021

(30) Foreign Application Priority Data

Jan. 27, 2021 (CN) ..... 202110114081.8

(51) Int. Cl.

| | |
|---|---|
| ***F21V 23/04*** | (2006.01) |
| ***F21V 15/015*** | (2006.01) |
| ***F21K 9/272*** | (2016.01) |
| ***F21K 9/275*** | (2016.01) |
| ***F21Y 113/10*** | (2016.01) |

(52) U.S. Cl.
CPC ..... *F21V 23/04* (2013.01); *F21K 9/272* (2016.08); *F21K 9/275* (2016.08); *F21V 15/015* (2013.01); *F21Y 2113/10* (2016.08)

(58) Field of Classification Search
CPC ..... F21S 10/023; F21V 23/04; F21K 9/272; F21K 9/275
See application file for complete search history.

(56) References Cited

U.S. PATENT DOCUMENTS

| | | | | |
|---|---|---|---|---|
| 9,719,642 | B1 * | 8/2017 | Macias | H05B 45/10 |
| 2010/0102729 | A1 * | 4/2010 | Katzir | F21K 9/278 315/113 |
| 2012/0106157 | A1 * | 5/2012 | Simon | H01R 33/96 362/249.05 |
| 2020/0187319 | A1 * | 6/2020 | Jiang | H05B 47/19 |
| 2021/0054974 | A1 * | 2/2021 | Li | F21K 9/272 |

* cited by examiner

*Primary Examiner* — William N Harris
(74) *Attorney, Agent, or Firm* — Winston Hsu

(57) ABSTRACT

A lamp socket of a color temperature adjustable lamp tube includes a housing and a color temperature adjustment member. The color temperature adjustment member is disposed on the housing and is connected to a plurality of light emitting members corresponding to two or more color temperatures. The color temperature adjustment member is provided for switching the light emitting members to change the color temperature of a light.

8 Claims, 8 Drawing Sheets

3

COLOR TEMPERATURE ADJUSTABLE LAMP SOCKET AND COLOR TEMPERATURE ADJUSTABLE LAMP TUBE

CROSS REFERENCE TO RELATED APPLICATION

This application claims the priority benefit of China Patent Application No. 202110114081.8, filed 2021 Jan. 27, and included herein in its entirety.

BACKGROUND OF THE INVENTION

1. Field of the Invention

The present invention relates to a lamp socket, especially for a lamp socket of a tube-shaped lamp with color temperature adjustable function. The present invention also relates to a color temperature lamp tube having the lamp socket.

2. Description of the Prior Art

Tubular lamps (T-tubes) are a common item in people's daily life; and with the continuous progress of technology, the functions and efficiency of tubular lamps have also been substantially improved. However, the existing tubular lamps still have many shortcomings to be improved.

For example, the existing tubular lamps due to the lack of appropriate design, so after damage can only be discarded and replaced with a new lamp, which limits the service life of the existing tubular lamps, but also significantly increase the amount of waste, cannot meet the needs of today's environmental protection.

In addition, the existing tubular lamps can only provide a color temperature and power, and cannot switch color temperature and power, so the application is greatly limited, and therefore cannot effectively relieve the supplier's inventory pressure.

SUMMARY OF THE INVENTION

In view of these, an embodiment of the present invention provides a color temperature adjustable lamp socket. The color temperature adjustable lamp socket comprises a housing and a color temperature adjustment element. The color temperature adjustment element is disposed on the housing, and the color temperature adjustment element is connected to a plurality of light emitting members corresponding to two or more color temperatures. The color temperature adjustment element is provided for switching the light emitting members to change a color temperature of a light.

Another embodiment of the present invention provides a color temperature adjustable lamp tube. The color temperature adjustable lamp tube comprises a lamp socket and a plurality of light emitting members. The lamp socket comprises a housing and a color temperature adjustment element. The color temperature adjustment element is disposed on the housing. The light emitting members correspond to two or more color temperatures. The color temperature adjustment element is provided for switching the light emitting members to change a color temperature of a light.

The above description of the contents of the present invention and the following description of specific embodiments are intended to demonstrate and explain the spirit and principles of the present invention and to provide a further explanation of the claims of the present invention.

These and other objectives of the present invention will no doubt become obvious to those of ordinary skill in the art after reading the following detailed description of the preferred embodiment that is illustrated in the various figures and drawings.

DETAILED DESCRIPTION

Embodiments of a polarity correction circuit for dimmer provided by the present invention will be described below with reference to the relevant figures. For the sake of clarity and convenience in the description of the figures, the various components of the figures may be exaggerated or reduced in size and proportion. In the following description and/or claims, when referring to a component "connected" or "coupled" to another component, it may be directly connected or coupled to that other component or an intervening component may exist; and when referring to a component "directly connected" or "directly coupled" to another component, no intervening component exists and other words used to describe the relationship between components or layers shall be construed in the same manner. For ease of understanding, the same components in the following embodiments are indicated by the same reference numbers.

Figure 1:
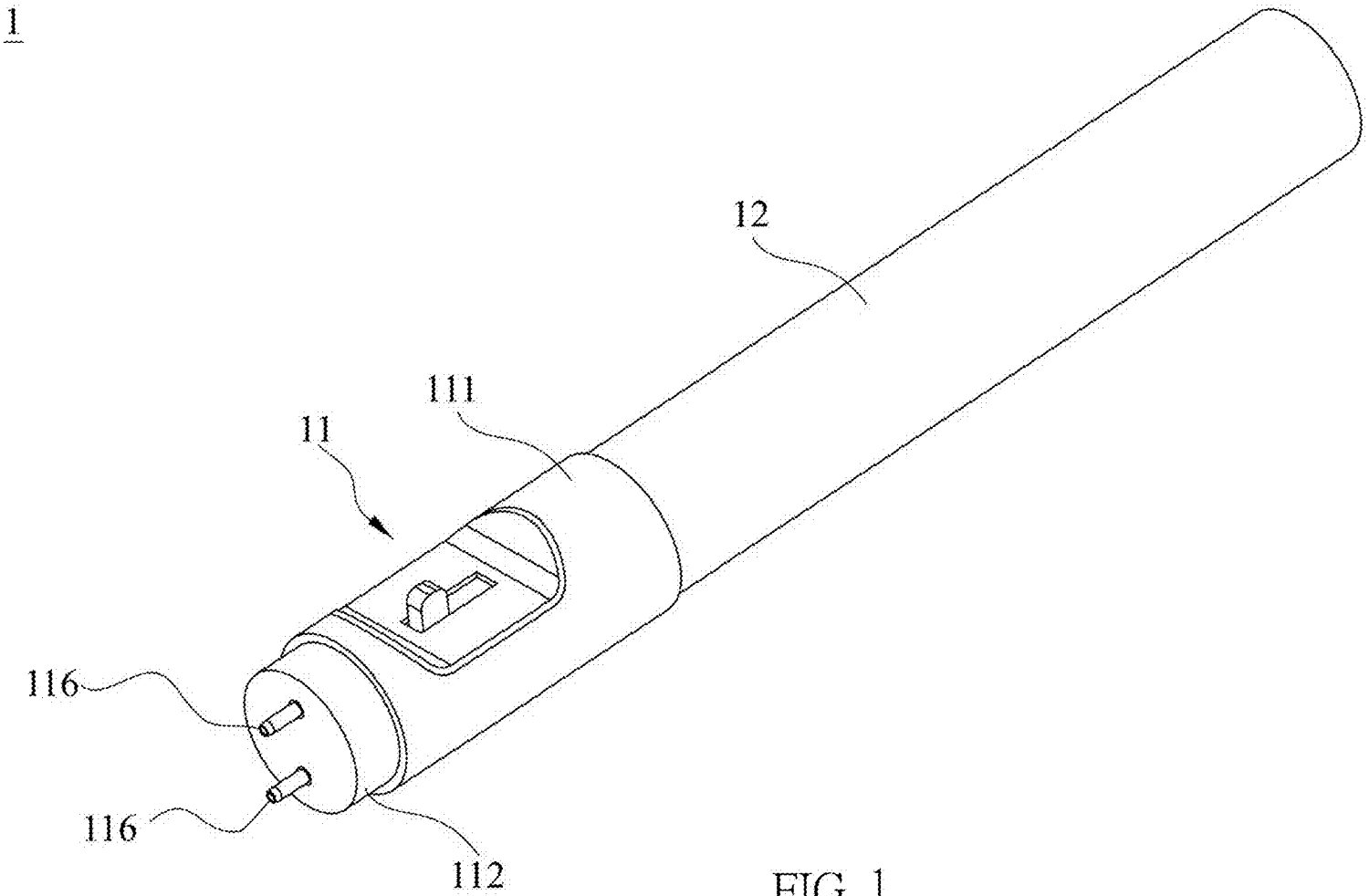
FIG. 1 illustrates a perspective view of a color temperature adjustable lamp tube according to a first embodiment of the present invention.

Please refer to FIG. 1, which illustrates a perspective view of a color temperature adjustable lamp tube according to a first embodiment of the present invention. As shown, the color temperature adjustable lamp tube 1 comprises a color temperature adjustable lamp socket 11 and a tube member 12. The color temperature adjustable lamp socket 11 comprises a housing 111 and an end cap 112. The housing 111 is tube shaped. The end cap 112 is disposed on one end of the housing 111, and the tube member 12 is disposed on the other end of the housing 111. A plurality of light emitting members (not shown) is disposed in tube member 12 and corresponds to two or more color temperatures. The light emitting members may be, but not limited to, light emitting elements (LEDs), fluorescent lamps, or any existing light emitting components. The tube member 12 is made of translucent or semi-translucent materials.

Figure 2A:
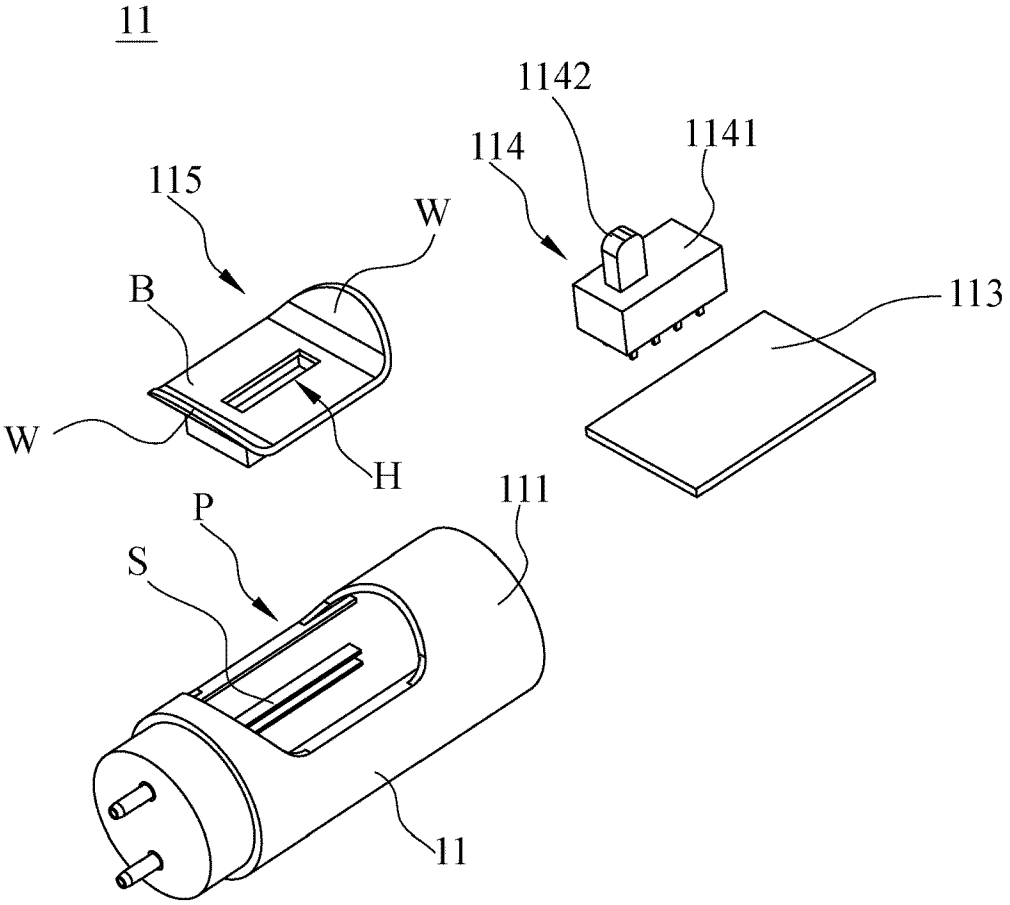
FIG. 2A illustrates an exploded view of a color temperature adjustable lamp socket of the first embodiment.
Figure 2B:
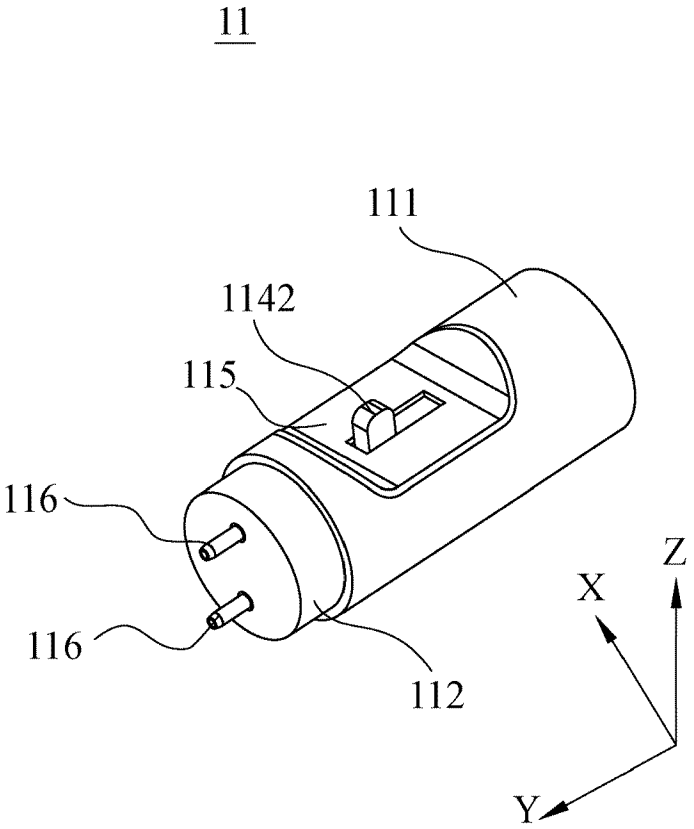
FIG. 2B illustrates an assembled view of the color temperature adjustable lamp socket of the first embodiment.

Please refer to FIGS. 2A and 2B, which respectively illustrate an exploded view and an assembled view of a color temperature adjustable lamp socket of the first embodiment. As shown, the color temperature adjustable lamp socket 11 comprises a housing 111, an end cap 112, a circuit board 113, a color temperature adjustment element, a protection cover 115, and two pins 116. In this embodiment, the color temperature adjustment element is a color temperature switch 114. In another embodiment, the color temperature adjustment element may be components with similar functions.

A surface of the housing 111 has an opening P. Moreover, two positioning slots S are provided in the housing 111. In this embodiment, each of the positioning slots S may comprises two adjacent ribs. In another embodiment, the positioning slots S may be accomplished by other structures.

The circuit board 113 is disposed in the housing 111 and is positioned on the positioning slots S.

The color temperature switch 114 comprises a switch body 1141 and a control body 1142. The control portion 1142 is connected to the switch body 1141 and is exposed from the opening P. In this embodiment, the control portion 1142 may be but not limited to a control lever. In another embodiment, the control portion may be accomplished by other structures.

The protection cover 115 is disposed on the housing 111 and has a switch slot H. The protection cover 115 covers the opening P, and the control portion 1142 is exposed from the switch slot H. The protection cover 115 comprises a bottom plate B and two side wings W. One of the side wings W is disposed on one end of the bottom plate B, the other side wing W is disposed on the other end of the bottom plate B, and an angle between each of the side wings W and the bottom plate B is less than 180 degrees.

The end cap 112 is disposed on one end of the housing 111, the pins 116 are disposed on the end cap 112, and the pins 116 are electrically connected to the circuit board 113 through the end cap 112.

Figure 3A:
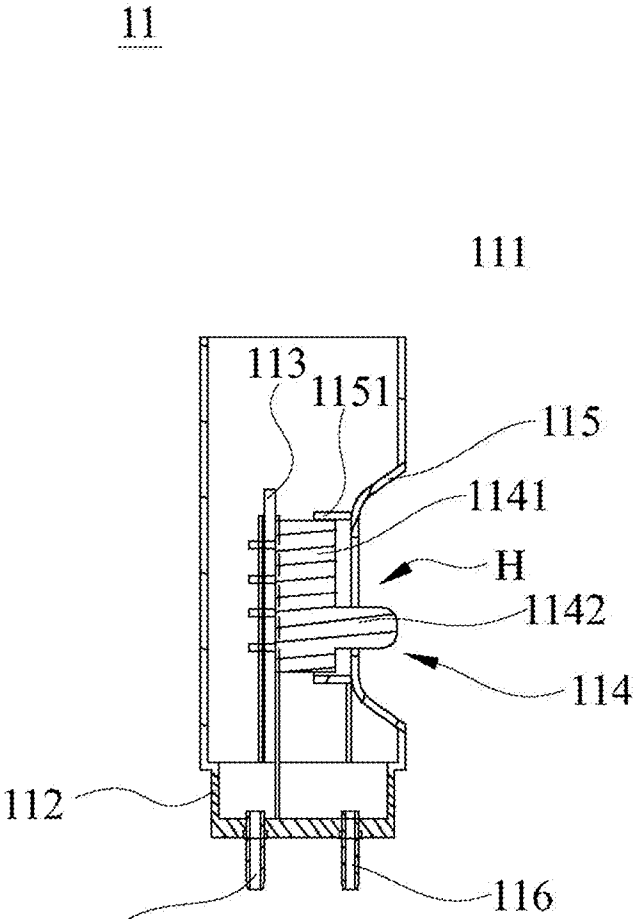
FIG. 3A illustrates a first cross-sectional view of the color temperature adjustable lamp socket of the first embodiment.
Figure 3B:
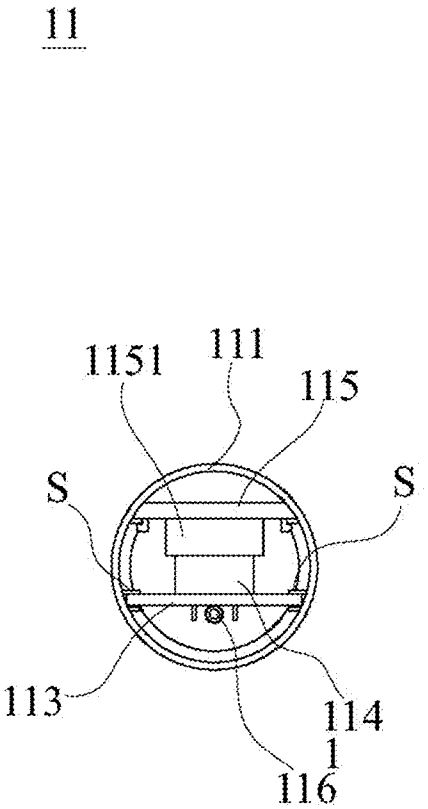
FIG. 3B illustrates a second cross-sectional view of the color temperature adjustable lamp socket of the first embodiment.

Please refer to FIGS. 3A and 3B, which respectively illustrate a first cross-sectional view (along the yz plane) and a second cross-sectional view (along the xz plane) of the color temperature adjustable lamp socket of the first embodiment. Please also refer to FIG. 2B. As shown, two sides of the circuit board 113 can be respectively slid into the positioning slots S, so that the circuit board 113 is positioned on the positioning slots S. Moreover, the protection cover 115 further comprises a fixing portion 1151, and the fixing portion 1151 is assembled on the switch body 1141. Furthermore, as mentioned above, since angles are defined between the bottom plate B of the protection cover 115 and the two side wings W, a recessed portion can be formed accordingly, and the control portion 1142 is disposed at a bottom portion of the recessed portion.

Based on the above, in this embodiment, the color temperature adjustable lamp socket 11 of the color temperature adjustable lamp tube 1 can have an integrated color temperature switch 114. Therefore, a user can toggle the control portion 1142 of the color temperature switch 114 to switch the light emitting members of the color temperature adjustable lamp tube 1 so as to adjust the color temperature and/or the power value of the light. Consequently, even if one of the color temperatures or power values of the color temperature adjustable lamp tube 1 is damaged due to some reasons, the user can continue to use the color temperature adjustable lamp tube 1 by toggling the control portion 1142 of the color temperature switch 114 of the color temperature adjustable lamp tube 1 to another color temperature or power value, thereby extending the service life of the color temperature adjustable lamp tube 1. It is noted that, the provided switch structure is for illustrative purpose. The switch structure of the color temperature adjustable lamp tube 1 may be designed individually for different applications so as to achieve the optimized effect.

Moreover, since the color temperature adjustable lamp socket 11 of the color temperature adjustable lamp tube 1 can have an integrated color temperature switch 114, suppliers can switch the light emitting members of the color temperature adjustable lamp tube to change the color temperature and/or the power value of the light, thus allowing the color temperature adjustable lamp tube to be meet requirements in different applications. Consequently, the inventory pressure of the supplier can be effectively reduced.

It is understood that, the switch structure, structure of components, and the cooperation relationship between the components of the color temperature adjustable lamp tube 1 can be changed according to practical requirements, embodiments are not limited thereto.

Figure 4:
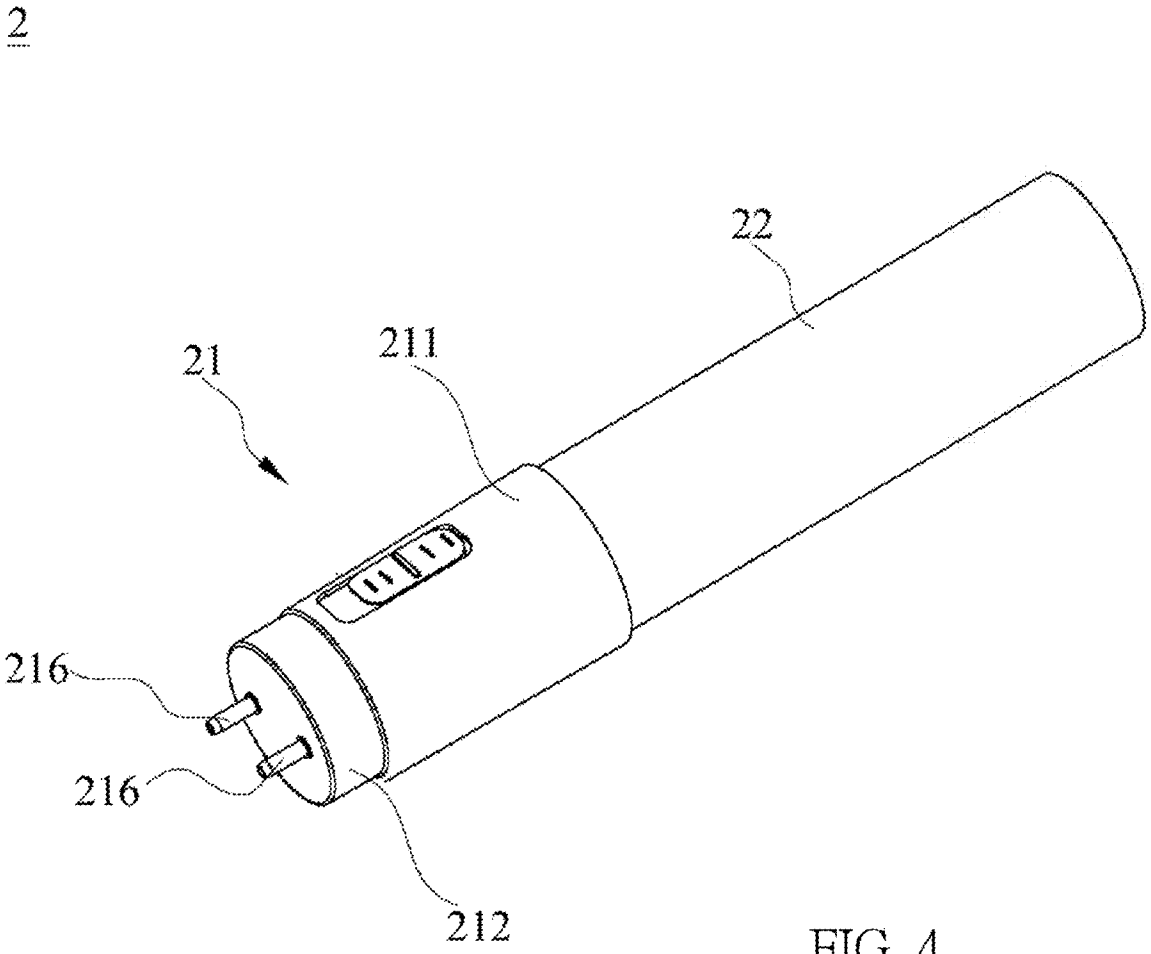
FIG. 4 illustrates a perspective view of a color temperature adjustable lamp tube according to a second embodiment of the present invention.

Please refer to FIG. 4, which illustrates a perspective view of a color temperature adjustable lamp tube according to a second embodiment of the present invention. As shown, the color temperature adjustable lamp tube 2 comprises a color temperature adjustable lamp socket 21 and a tube member 22. The color temperature adjustable lamp socket 21 comprises a housing 211 and an end cap 212. The housing 211 is tube shaped. The end cap 212 is disposed on one end of the housing 211, and the tube member 22 is disposed on the other end of the housing 211. One or more light emitting members are disposed in tube member 22. The tube member 22 is made of translucent or semi-translucent materials.

Figure 5A:
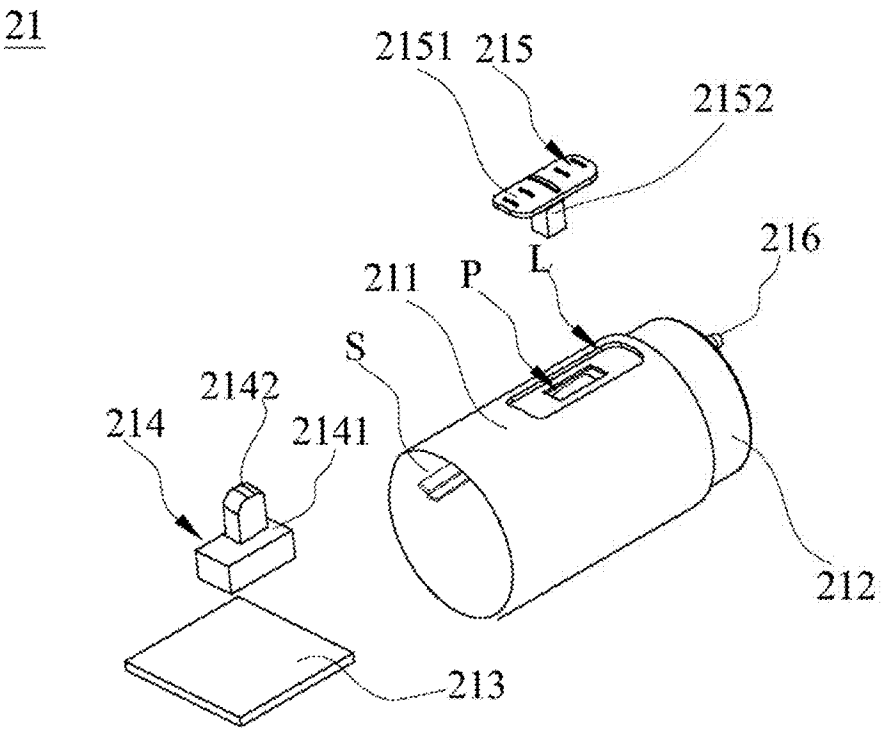
FIG. 5A illustrates an exploded view of a color temperature adjustable lamp socket of the second embodiment.
Figure 5B:
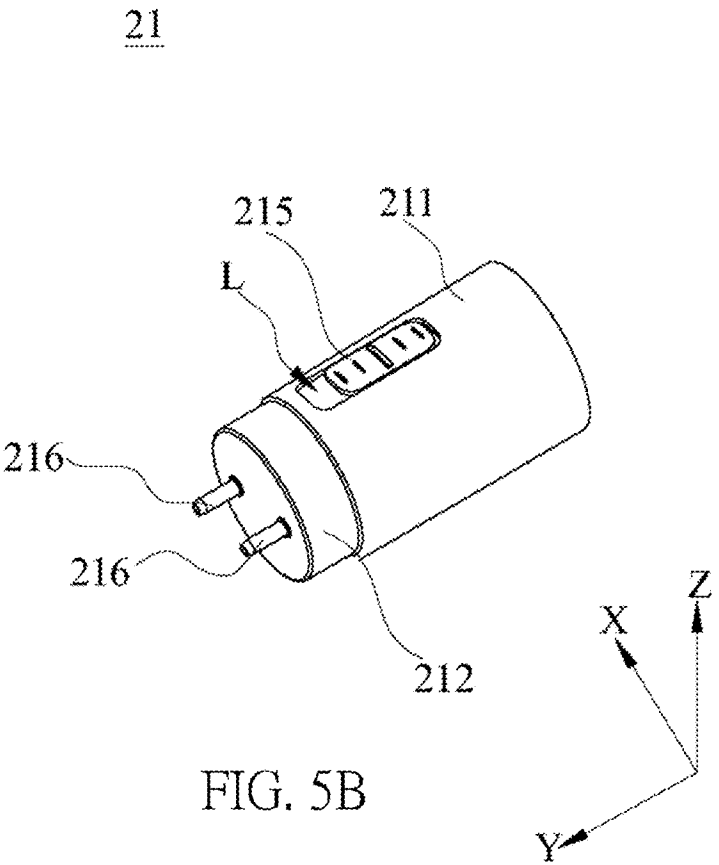
FIG. 5B illustrates an assembled view of the color temperature adjustable lamp socket of the second embodiment.

Please refer to FIGS. 5A and 5B, which respectively illustrate an exploded view and an assembled view of a color temperature adjustable lamp socket of the second embodiment. As shown, the color temperature adjustable lamp socket 21 comprises a housing 211, an end cap 212, a circuit board 213, a color temperature adjustment element, a slidable button 215, and two pins 216. In this embodiment, the color temperature adjustment element is a color temperature switch 214. In another embodiment, the color temperature adjustment element may be components with similar functions.

A surface of the housing 211 has an opening P and a slide slot L. The slide slot L is disposed at the opening P. Moreover, two positioning slots S are provided in the housing 211.

The circuit board 213 is disposed in the housing 211 and is positioned on the positioning slots S.

The color temperature switch 214 comprises a switch body 2141 and a control body 2142. The control portion 2142 is connected to the switch body 2141 and is exposed from the opening P.

The slidable button 215 comprises a slidable portion 2151 and a connection portion 2152. The slidable portion 2151 is connected to connection portion 2152. The connection portion 2152 is fitted over the control portion 2142.

The end cap 212 is disposed on one end of the housing 211, the pins 216 are disposed on the end cap 212, and the pins 216 are electrically connected to the circuit board 213 through the end cap 212.

Figure 6A:
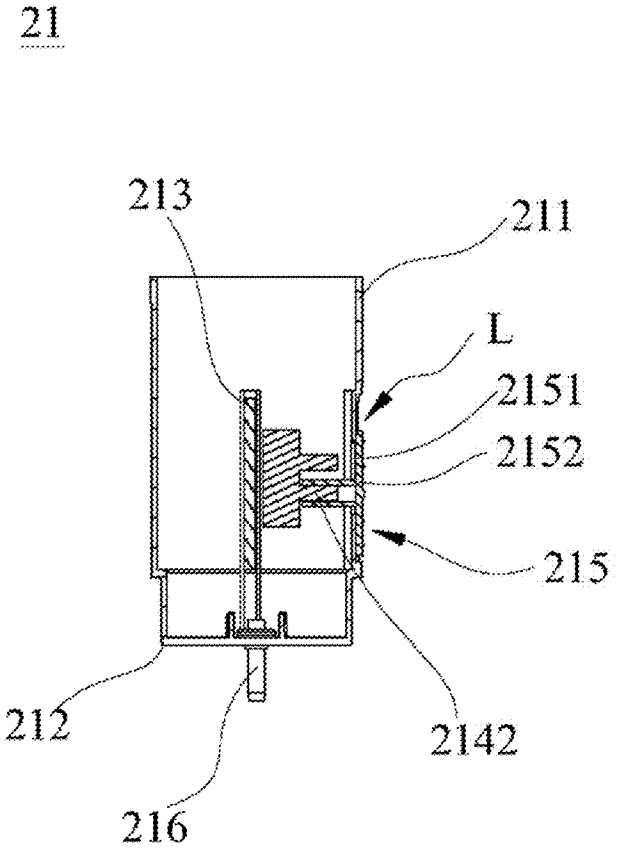
FIG. 6A illustrates a first cross-sectional view of the color temperature adjustable lamp socket of the second embodiment.
Figure 6B:
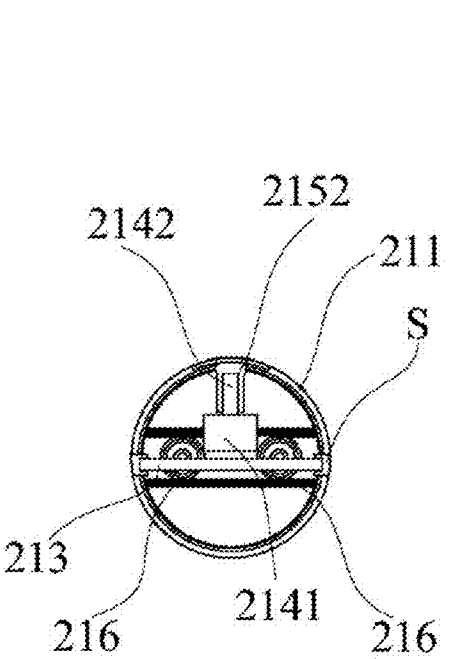
FIG. 6B illustrates a second cross-sectional view of the color temperature adjustable lamp socket of the second embodiment.

Please refer to FIGS. 6A and 6B, which respectively illustrate a first cross-sectional view (along the yz plane) and a second cross-sectional view (along the xz plane) of the color temperature adjustable lamp socket of the second embodiment. Please also refer to FIG. 5B. As shown, two sides of the circuit board 213 can be respectively slid into the positioning slots S, so that the circuit board 213 is positioned on the positioning slots S. Moreover, as mentioned above, the connection portion is fitted over the control portion, the color temperature switch 214 can be switched by toggling the slidable button 215 of the color temperature switch 214 to switch the light emitting members of the color temperature adjustable lamp tube 2 so as to adjust the color temperature and/or the power value of the light.

Based on the above, in this embodiment, the color temperature adjustable lamp socket 21 of the color temperature adjustable lamp tube 2 can also have an integrated color temperature switch 214. Therefore, the user can toggle the slidable button 215 to switch the control portion 2142 of the color temperature switch 214 to switch the light emitting members of the color temperature adjustable lamp tube 2 so as to adjust the color temperature and/or the power value of the light.

Moreover, in this embodiment, the color temperature switch 214 of the color temperature adjustable lamp socket 21 of the color temperature adjustable lamp tube 2 can be integrated with the switch structure of the slidable button 215, thus providing an operation manner different from the first embodiment and meeting different user habits.

It is understood that, the switch structure, structure of components, and the cooperation relationship between the components of the color temperature adjustable lamp tube 2 can be changed according to practical requirements, embodiments are not limited thereto.

Figure 7:
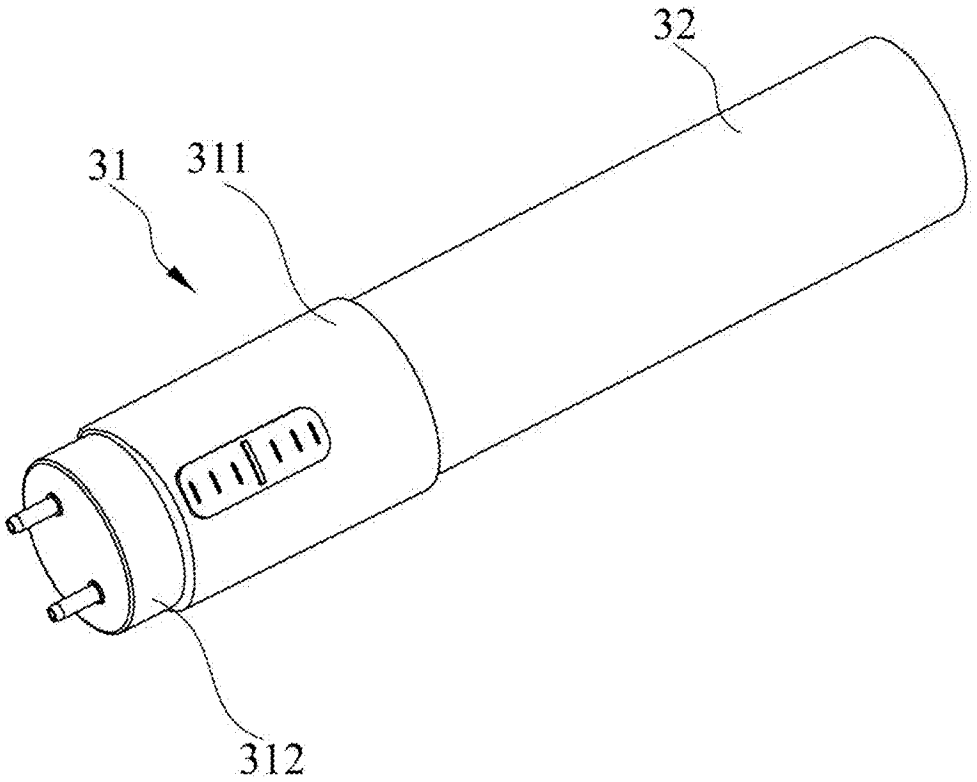
FIG. 7 illustrates a perspective view of a color temperature adjustable lamp tube according to a third embodiment of the present invention.

Please refer to FIG. 7, which illustrates a perspective view of a color temperature adjustable lamp tube according to a third embodiment of the present invention. As shown, the color temperature adjustable lamp tube 3 comprises a color temperature adjustable lamp socket 31 and a tube member 32. The color temperature adjustable lamp socket 31 comprises a housing 311 and an end cap 312. The housing 311 is tube shaped. The end cap 312 is disposed on one end of the housing 311, and the tube member 32 is disposed on the other end of the housing 311. One or more light emitting members are disposed in tube member 32. The tube member 32 is made of translucent or semi-translucent materials.

Figure 8A:
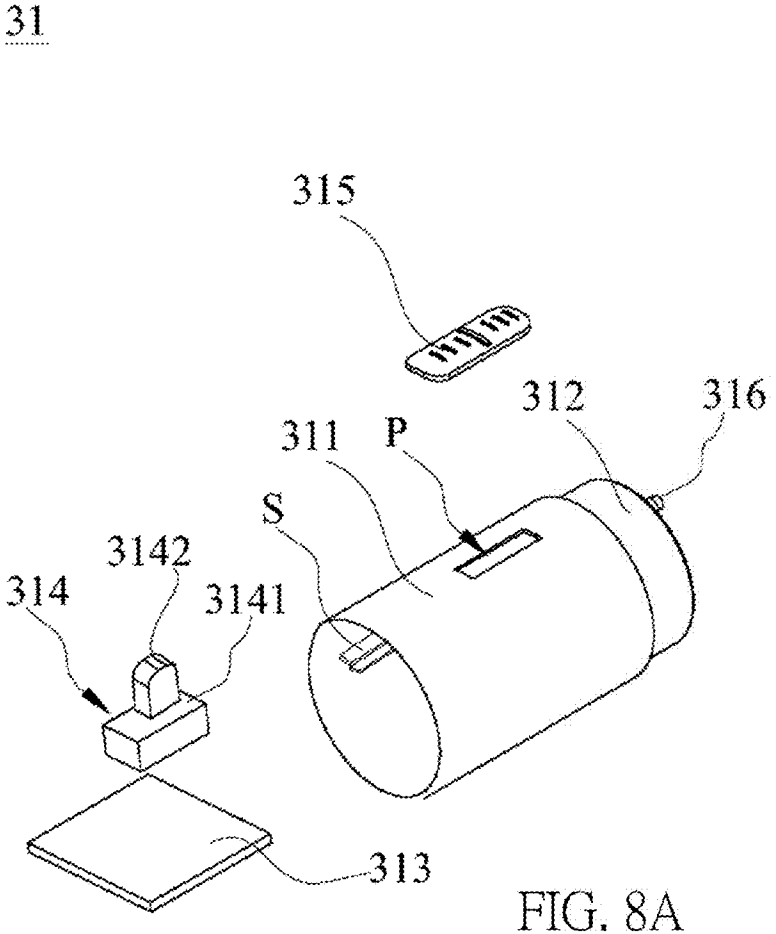
FIG. 8A illustrates an exploded view of a color temperature adjustable lamp socket of the third embodiment.
Figure 8B:
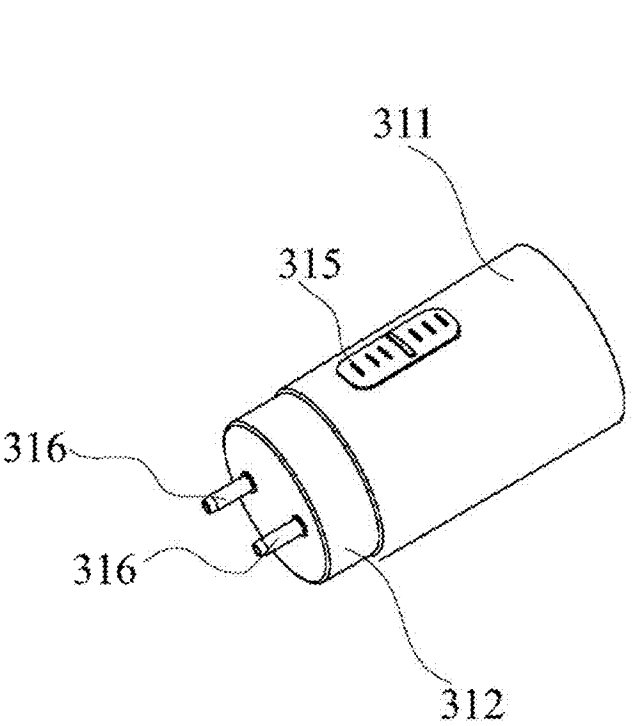
FIG. 8B illustrates an assembled view of the color temperature adjustable lamp socket of the third embodiment.

Please refer to FIGS. 8A and 8B, which respectively illustrate an exploded view and an assembled view of a color temperature adjustable lamp socket of the third embodiment. As shown, the color temperature adjustable lamp socket 31 comprises a housing 311, an end cap 312, a circuit board 313, a color temperature switch 314, a button 315, and two pins 316.

A surface of the housing 311 has an opening P. Moreover, two positioning slots S are provided in the housing 311.

The circuit board 313 is disposed in the housing 311 and is positioned on the positioning slots S.

The color temperature switch 314 comprises a switch body 3141 and a control body 3142. The control portion 3142 is connected to the switch body 3141 and is exposed from the opening P.

The button 315 is disposed on the housing 311 and covers the opening P, so that the button 315 contacts the control portion 3142.

The end cap 312 is disposed on one end of the housing 311, the pins 316 are disposed on the end cap 312, and the pins 316 are electrically connected to the circuit board 313 through the end cap 312. It is noted that, in this embodiment, the internal structure of the color temperature adjustable lamp socket 31 is similar to the internal structures of the foregoing embodiments, repeated descriptions are omitted.

Based on the above, in this embodiment, the color temperature adjustable lamp socket 31 of the color temperature adjustable lamp tube 3 can also have an integrated color temperature switch 314. Therefore, the user can press the button 315 to switch the control portion 3142 of the color temperature switch 314 to switch the light emitting members of the color temperature adjustable lamp tube 3 so as to adjust the color temperature and/or the power value of the light.

Moreover, in this embodiment, the color temperature switch 314 of the color temperature adjustable lamp socket 31 of the color temperature adjustable lamp tube 3 can be integrated with the switch structure of the button 315, thus providing an operation manner different from the first and second embodiments and meeting different user habits. It is noted that, the provided switch structure is for illustrative purpose. The switch structure of the color temperature adjustable lamp tube 3 may be designed individually for different applications so as to achieve the optimized effect.

It is understood that, the switch structure, structure of components, and the cooperation relationship between the components of the color temperature adjustable lamp tube 3 can be changed according to practical requirements, embodiments are not limited thereto.

As above, according to embodiment (s) of the present invention, the lamp socket of the color temperature adjustable lamp tube has a color temperature switch integrated with the lamp socket, and the color temperature switch is provided for switching the light emitting members of the lamp tube so as to change the color temperature and/or the power value of the light. Therefore, when one of the color temperatures or power values of the lamp tube is damaged, the lamp tube can be switched to another color temperature or power value for continued use, thereby greatly extending the service life of the color temperature adjustable lamp tube as well as reducing amount of waste, which can meet the needs of today's environmental protection concern.

Furthermore, according to embodiment(s) of the present invention, the lamp socket of the color temperature adjustable lamp tube has a color temperature switch integrated with the lamp socket. Therefore, the color temperature and/or power value of the light of the light emitting member of the lamp tube can be adjusted according to requirements for different applications, thus allowing the lamp tube to have wider applications.

Moreover, according to embodiment (s) of the present invention, the color temperature switch of the lamp socket of the color temperature adjustable lamp tube can be used to adjust the color temperature and/or power value of the light of the light emitting member of the color temperature adjustable lamp tube according to requirements for different applications. Therefore, the application for the color temperature adjustable lamp tube is not limited a single color temperature or power value, thus allowing the product supply of the suppliers to be more flexible. Consequently, the inventory pressure of the supplier can be effectively reduced.

Moreover, according to embodiment (s) of the present invention, the color temperature switch of the lamp socket of the color temperature adjustable lamp tube can be integrated with the switch structure in different configurations, thus providing different operation manners and meeting different user habits.

Furthermore, according to embodiment(s) of the present invention, the design of the color temperature adjustable lamp tube is simple. Therefore, the foregoing purposes can be achieved without greatly increasing the manufacturing costs of the lamp tube. Hence, the present invention has high commercial value.

Although particular embodiments of the invention have been described in detail for purposes of illustration, various modifications and enhancements may be made without departing from the spirit and scope of the invention. Accordingly, the invention is not to be limited except as by the appended claims.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A color temperature adjustable lamp socket, comprising:

a housing, wherein a surface of the housing has an opening;

a color temperature adjustment element disposed on the housing, wherein the color temperature adjustment element is a color temperature switch connected to a plurality of light emitting members corresponding to two or more color temperatures, the color temperature adjustment element is provided for switching the light emitting members to change a color temperature of a light, and a position of the color temperature switch corresponds to the opening, wherein the color temperature switch comprises a switch body and a control portion, and the control portion is connected to the switch body and is exposed from the opening; and a protection cover disposed on the housing and having a switch slot, wherein the protection cover covers the opening, and the control portion is exposed from the switch slot, wherein the protection cover comprises a bottom plate and two side wings, one of the side wings is disposed on one end of the bottom plate, and the other of the side wings is disposed on the other end of the bottom plate, wherein an angle between each of the side wings and the bottom plate is less than 180 degrees.

2. The color temperature adjustable lamp socket as claimed in claim 1, further comprising a circuit board, an end cap, and a plurality of pins, wherein the housing is tube shaped, the circuit board is disposed in the housing, the color temperature switch is disposed on the circuit board and is electrically connected to the circuit board, the pins are disposed on the end cap and are electrically connected to the circuit board through the end cap.

3. The color temperature adjustable lamp socket as claimed in claim 1, further comprising a button disposed on the housing and covering the opening, so that the button contacts the control portion.

4. The color temperature adjustable lamp socket as claimed in claim 1, wherein the surface of the housing has a slide slot and a slidable button, the slide slot is disposed at the opening, the slidable button comprises a slidable portion and a connection portion, the slidable portion is connected to the connection portion, and the connection portion is fitted over the control portion.

5. A color temperature adjustable lamp tube, comprising:

a lamp socket, comprising:

a housing, wherein a surface of the housing has an opening;

a color temperature adjustment element disposed on the housing, wherein the color temperature adjustment element is a color temperature switch, and a position of the color temperature switch corresponds to the opening, wherein the color temperature switch comprises a switch body and a control portion, and the control portion is connected to the switch body and is exposed from the opening; and a protection cover disposed on the housing and having a switch slot, wherein the protection cover covers the opening, and the control portion is exposed from the switch slot, wherein the protection cover comprises a bottom plate and two side wings, one of the side wings is disposed on one end of the bottom plate, and the other of the side wings is disposed on the other end of the bottom plate, wherein an angle between each of the side wings and the bottom plate is less than 180 degrees, and a plurality of light emitting members corresponding to two or more color temperatures;

wherein the color temperature element is provided for switching the light emitting members to change a color temperature of a light.

6. The color temperature adjustable lamp tube as claimed in claim 5, wherein the lamp socket further comprises a circuit board, an end cap, and a plurality of pins, the housing is tube shaped, the circuit board is disposed in the housing, the color temperature switch is disposed on the circuit board and is electrically connected to the circuit board, the pins are disposed on the end cap and are electrically connected to the circuit board through the end cap.

7. The color temperature adjustable lamp tube as claimed in claim 5, wherein the lamp socket further comprises a button disposed on the housing and covering the opening, so that the button contacts the control portion.

8. The color temperature adjustable lamp tube as claimed in claim 5, wherein the surface of the housing has a slide slot and a slidable button, the slide slot is disposed at the opening, the slidable button comprises a slidable portion and a connection portion, the slidable portion is connected to the connection portion, and the connection portion is fitted over the control portion.

* * * * *